US008410403B2

(12) United States Patent
Walker, Jr.

(10) Patent No.: US 8,410,403 B2
(45) Date of Patent: Apr. 2, 2013

(54) GLOW PLUG WITH IMPROVED SEAL, HEATER PROBE ASSEMBLY THEREFOR AND METHOD OF CONSTRUCTION THEREOF

(75) Inventor: William J. Walker, Jr., Toledo, OH (US)

(73) Assignee: Federal Mogul Ignition Company, Southfield, MI (US)

( * ) Notice: Subject to any disclaimer, the term of this patent is extended or adjusted under 35 U.S.C. 154(b) by 729 days.

(21) Appl. No.: 12/603,653

(22) Filed: Oct. 22, 2009

(65) Prior Publication Data

US 2010/0133253 A1 Jun. 3, 2010

Related U.S. Application Data

(60) Provisional application No. 61/107,693, filed on Oct. 23, 2008.

(51) Int. Cl.
*F23Q 7/22* (2006.01)
*H05B 3/04* (2006.01)

(52) U.S. Cl. ..... 219/267; 219/270; 219/544; 219/546

(58) Field of Classification Search ..... 219/270
See application file for complete search history.

(56) References Cited

U.S. PATENT DOCUMENTS

| | | | | |
|---|---|---|---|---|
| 3,745,400 | A | 7/1973 | Meyer | |
| 4,477,717 | A | 10/1984 | Walton | |
| 4,963,717 | A | 10/1990 | Woelfle | |
| 5,767,485 | A | 6/1998 | Kumada | |
| 5,838,094 | A | 11/1998 | Hanspal | |
| 6,130,410 | A * | 10/2000 | Kita | 219/270 |
| 6,699,807 | B2 | 3/2004 | Geier et al. | |
| 6,759,631 | B1 | 7/2004 | Geissinger et al. | |
| 7,560,666 | B2 * | 7/2009 | Ando | 219/270 |
| 2002/0190049 | A1 | 12/2002 | Terada | |
| 2003/0029857 | A1 * | 2/2003 | Taniguchi et al. | 219/270 |
| 2004/0222207 | A1 | 11/2004 | Kumada | |

(Continued)

FOREIGN PATENT DOCUMENTS

| | | |
|---|---|---|
| DE | 3520923 | 12/1985 |
| EP | 1241412 A2 | 9/2002 |
| GB | EP 0365258 A1 | 4/1990 |
| WO | 9118244 A1 | 11/1991 |

OTHER PUBLICATIONS

European Search Report for EP09822684 mailed on Jun. 19, 2012.

*Primary Examiner* — Stephen W Smoot
(74) *Attorney, Agent, or Firm* — Robert L. Stearns; Dickinson Wright, PLLC

(57) ABSTRACT

A heater probe assembly, a metallic glow plug assembly therewith and method of constructing the heater probe assembly is provided. The metallic glow plug assembly includes a metal shell having a through bore and a metal sheath extending between a distal end and a terminal end. The terminal end of the metal sheath is fixed in the through bore of the shell. Further, an electrode is provided having an end with a heating element attached to thereto. The heating element and end of the electrode are received in the sheath. A packing powder is disposed in the sheath about the heating element. Further, a ceramic seal has an outer surface attached to the sheath by a braze joint and an inner surface attached to the electrode by a braze joint. The ceramic seal provides a hermetic seal between the packing powder and an environment external to the sheath.

16 Claims, 3 Drawing Sheets

U.S. PATENT DOCUMENTS

2005/0168121 A1 8/2005 Tinwell
2007/0252501 A1 11/2007 Tinwell
2009/0184101 A1* 7/2009 Hoffman et al. ..... 219/270

* cited by examiner

GLOW PLUG WITH IMPROVED SEAL, HEATER PROBE ASSEMBLY THEREFOR AND METHOD OF CONSTRUCTION THEREOF

CROSS-REFERENCE TO RELATED APPLICATION

This application claims the benefit of U.S. Provisional Application Ser. No. 61/107,693, filed Oct. 23, 2008, which is incorporated herein by reference in its entirety.

BACKGROUND OF THE INVENTION

1. Field of the Invention

This invention relates generally to glow plugs and, more particularly, to sheathed glow plugs.

2. Related Art

Sheathed heater probe type glow plugs, as shown generally at 1 in prior art FIG. 1, typically have an annular metal shell with a bore 2 sized for fixed receipt of a heater probe assembly 3 therein. The heater probe assembly 3 includes a metallic sheath 4, electrode 5, resistance heating element 6, powder packing material 7, and an o-ring seal 8.

These o-ring seals have been made using various elastomers, including fluoropolymers such as those sold by DuPont under the VITON® brand. While o-ring seals have been used in many glow plug applications, their useful operating temperature range is about 100-200° C., which has now become a constraint in light of engine advancements which have elevated operating temperatures. As a consequence, glow plug applications have been emerging where a higher operating temperature range is needed and the prior art o-ring seals are not suitable.

In addition, even when operating within the lower temperature ranges of the prior art, the o-ring seals 8 are not hermetic and as a result oxygen and water vapor can permeate into the insulating powder 7 and onto the resistance heating element 6 to cause oxidation, cracking and eventually failure of the resistance heating element 6. This failure mode can serve to reduce or otherwise limit the service life of the glow plug 1.

Thus, conventional metallic glow plugs have a limited service life because of degradation of performance due to oxidation of their wire heating element. During thermal cycling, the surface of the wire 6 oxidizes, thereby reducing the effective cross-section of the embedded resistive wire. This eventually leads to overheating of portions of the wire. A major factor leading to this mode of failure is the imperfect seal of the rubber or plastic gasket, e.g., o-ring, which allows oxygen and water vapor to diffuse into the packed powder bed, wherein the oxygen and water vapor are free to react with the heating element wire. Interaction of the magnesium oxide and water vapor form magnesium hydroxide, which can result in failure of the part even before the part is placed into service. Furthermore, gases that are absorbed onto the surface of the magnesium powder may also contribute to the degradation of the heating element wire.

In view of the above, there exists a need for a glow plug that can be used at operating temperatures in the region of the seal above 200° C., and that can provide a true hermetic seal between the electrode and the sheath.

SUMMARY OF THE INVENTION

In accordance with one aspect of the invention, a metallic glow plug assembly is provided. The metallic glow plug assembly includes a metal shell having a through bore and a metal sheath extending between a distal end and a terminal end. The terminal end of the metal sheath is fixed in the shell. Further, an electrode is provided having an end with a heating element attached to thereto. The heating element and end of the electrode are received in the sheath. A packing powder is disposed in the sheath about the heating element. Further, a ceramic seal has an outer surface attached to the sheath by a braze joint and an inner surface attached to the electrode by a braze joint. The ceramic seal provides a hermetic seal between the packing powder and an environment external to the sheath.

In accordance with another aspect of the invention, a glow plug heater probe assembly is provided. The glow plug heater probe assembly includes a metal sheath extending between a distal end and a terminal end. Further, an electrode has an end with a heating element attached thereto, wherein the end and the heating element are received in the sheath. A packing powder is disposed in the sheath about the heating element. And, a ceramic seal has an outer surface attached to the sheath by a first braze joint and an inner surface attached to the electrode by a second braze joint to provide a hermetic seal between the packing powder and an environment external to the sheath.

In accordance with yet another aspect of the invention, a method of constructing a glow plug heater probe assembly is provided. The method includes providing a metal sheath having an open end; providing an electrode and attaching a heater element to the electrode. Further, disposing the heater element and an end of an electrode into the sheath and disposing packing powder about the heater element in the sheath. Further yet, disposing a ceramic seal about the electrode and within the sheath, and forming a braze joint between the sheath and the electrode to provide a hermetic seal between the packing powder and an environment external to the sheath.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

DETAILED DESCRIPTION OF THE PREFERRED EMBODIMENTS

Figure 2:
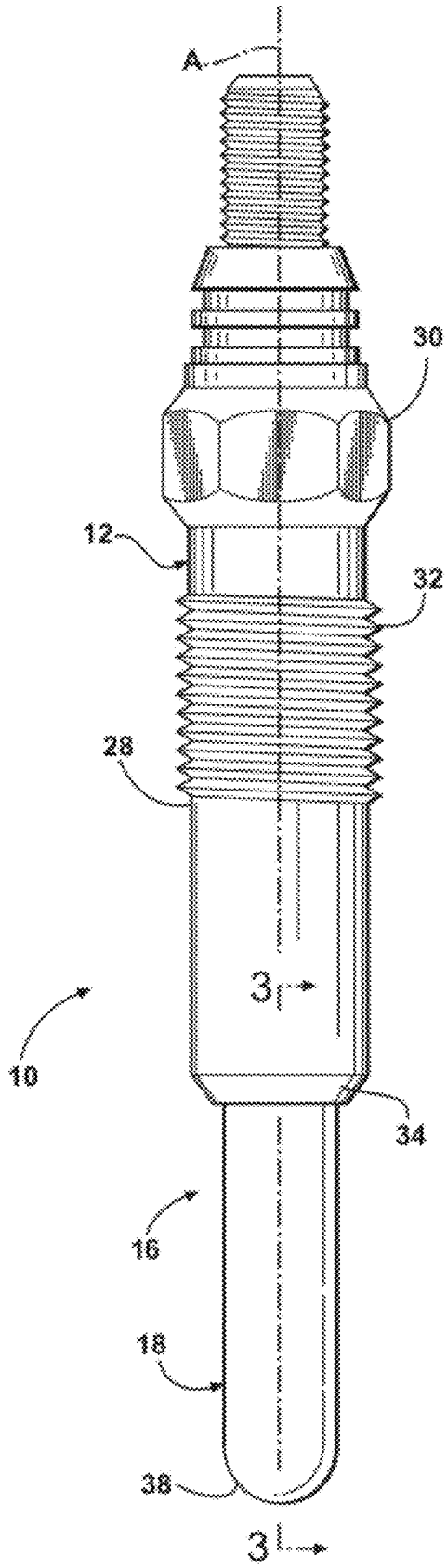
FIG. 2 is a side view of a glow plug constructed in accordance with one aspect of the invention.
Figure 3:
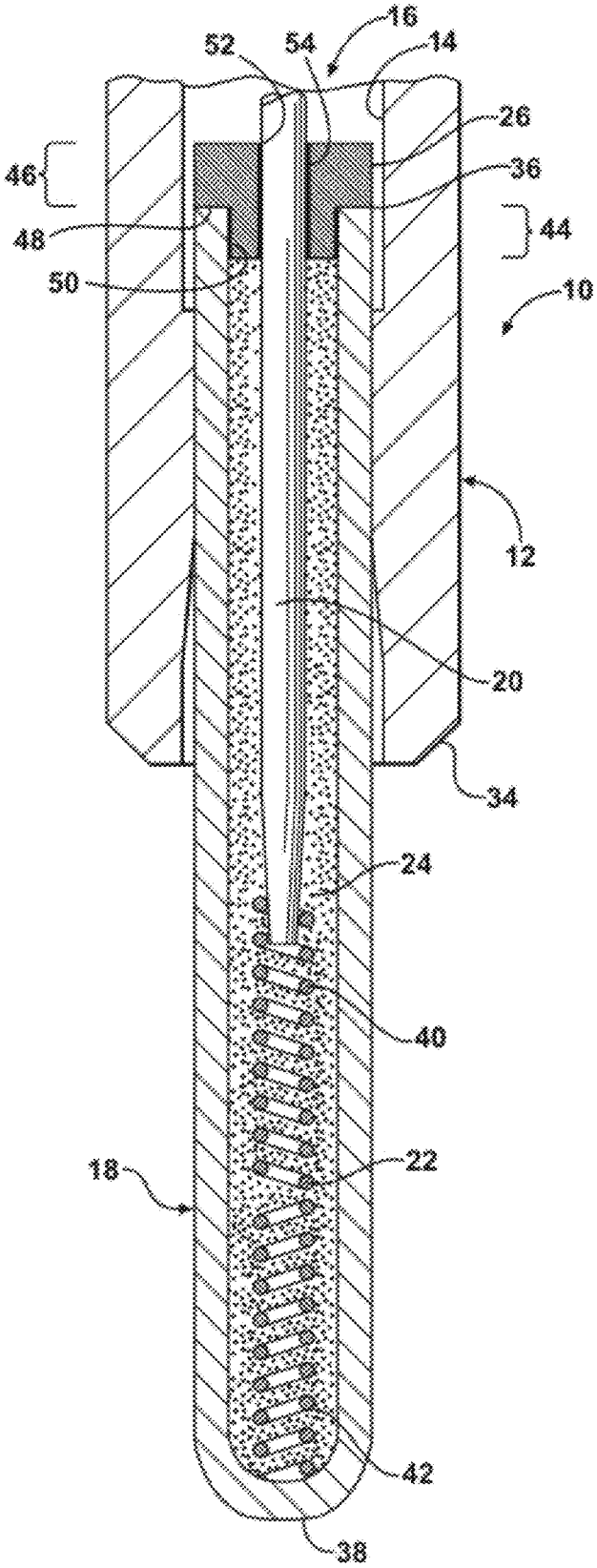
FIG. 3 is a cross-sectional view taken generally along the line 3-3 of FIG. 2.

Referring in more detail to the drawings, FIG. 2 illustrates a glow plug 10 constructed in accordance with one aspect of the invention. As shown in FIG. 3, the glow plug 10 includes an annular metal shell 12 having a through bore 14 sized for fixed receipt a heater probe assembly 16 constructed in accordance with one presently preferred embodiment of the invention at least partially therein. The heater probe assembly 16 includes tubular metallic sheath 18, electrode 20, resistance heating element 22, powder packing material 24, and an improved seal 26. The improved seal 26 is constructed of a ceramic material that, when fixed to the metal sheath 18 and electrode 20, is better adapted to isolate the resistance heating element 22 from oxygen and water vapor, and thus, the useful life of the glow plug 10 is enhanced.

As shown in FIG. 2, the metal shell 12 extends along an imaginary longitudinal axis A. The shell 12 may be formed from any suitable metal, such as various grades of steel. The shell 12 may also incorporate a plating or coating layer, such as a nickel or nickel alloy coating over some or all of its surfaces including an exterior surface 28 and within the bore 14 so as to improve its resistance to high temperature oxidation and corrosion. The shell 12 includes external wrenching flats 30 or other suitably configured tool-receiving portion to advance screw threads 32 into an appropriately tapped hole (not shown) in an engine cylinder head, pre-ignition chamber, intake manifold or the like. A tapered seat 34 bears against a complimentary-shaped pocket in the mating feature to perfect a pressure-tight seal in operation.

The sheath 18 is an electrically and thermally conductive member of generally tubular construction. Any suitable metal may be used to form the sheath 18, but metals having a resistance to high temperature oxidation and corrosion are preferred, particularly with respect to combustion gases and reactant species associated with the operation of an internal combustion engine. An example of a suitable metal alloy is a nickel-chrome-iron-aluminum alloy. As shown in FIG. 3, the sheath 18 has a terminal end, also referred to as a first open end 36, disposed within the through bore 14 of the shell 12 in electrical contact with the shell 12 and a distal end, also referred to as a second closed end 38, that projects out of a distal end of the through bore 14. The sheath 18 may have a deformed microstructure, such as a cold-worked microstructure where a sheath preform (not shown) is reshaped by swaging or otherwise to effect an overall reduction in diameter thereby increasing the density of the powder packing material 24 contained therein.

In FIG. 3, a fragmentary portion of the electrode 20 is depicted, showing an embedded section that extends into the first open end 36 of the sheath 18. The electrode 20 may be made from any suitable electrically conductive material, but is preferably a metal or even more preferably made from steel. Examples of suitable grades of steel include AISI 1040, AISI 300/400 family, EN 10277-3 family, Kovar*UNS K94610 and ASTM F15, 29-17 alloy.

The resistance heating element 22 may be any suitable resistance heating device, including a wound or spiral wound resistance heating element. The resistance heating element 22 may have any suitable resistance characteristics so long as it is operable to provide the necessary time/temperature heating response characteristics needed for a specified application of the glow plug 10. This may include an element comprising a single (i.e., homogenous) electrical resistance element with a positive temperature coefficient characteristic (PTC characteristic), or a dual construction in which two series-connected electrical resistance elements are joined end-to-end. In this latter scenario, a first resistance element 40 is connected directly to the electrode 20 and fabricated from a material having a higher PTC characteristic than a second resistance element 42 which is connected to the second closed end 38 of the sheath 18. Thus, the first resistance element 40 acts as a current limiter or regulator element, while the second resistance element 42 acts as the heating element. Spiral wire resistance heating elements may be formed from any suitable material, including various metals such as pure nickel, various nickel, nickel-iron-chromium and iron-cobalt alloys to name but a few. Thus, in the example shown in FIG. 3, a spiral wire, dual resistance heating element 22 is disposed in the sheath 20 with a proximal end thereof electrically connected and mechanically fixed by a metallurgical bond or weld to the electrode 22. A distal end of the resistance heating element 22 is electrically connected and mechanically fixed by a metallurgical bond to the second closed end 32 of the sheath 20. This mechanical attachment and metallurgical bond is formed when the distal end of the resistance heating element 22 is welded to the distal end of the sheath 20. This welding operation may be used to simultaneously form the closed end 32 of the tubular sheath 20 by sealing an opening in the distal end of an open ended perform.

Figure 1:
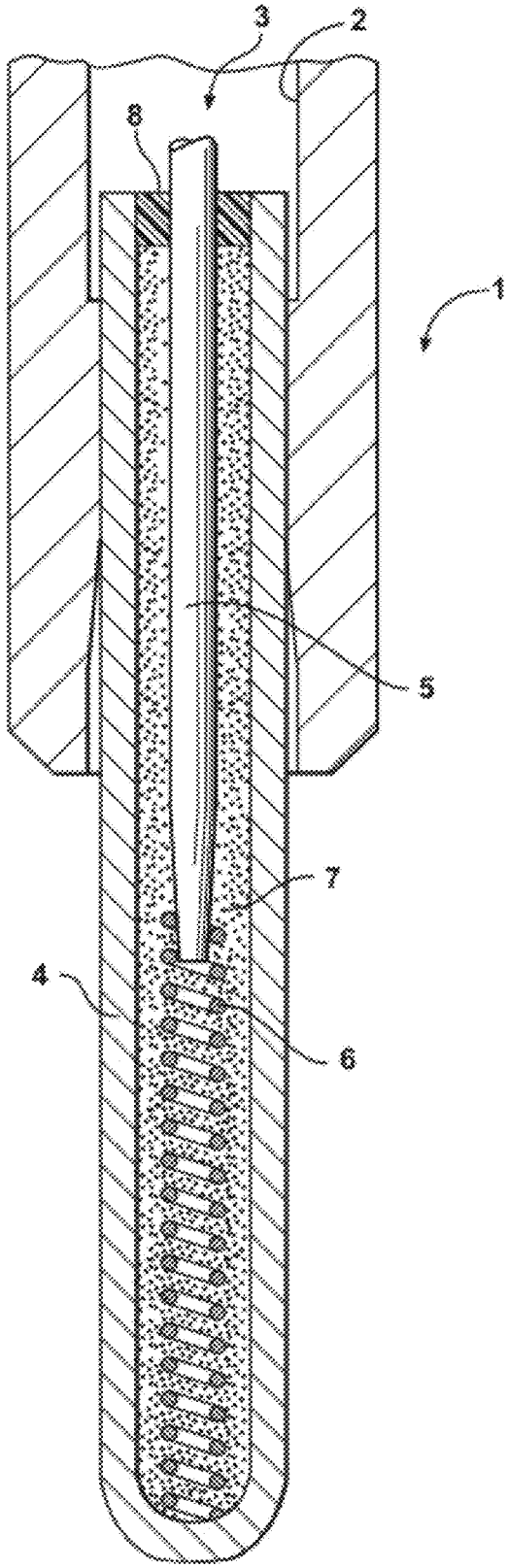
FIG. 1 Prior Art
FIG. 1 is partial cross-sectional view of a sheathed heater probe glow plug constructed in accordance with the prior art.

The conventional rubber or plastic prior art seal (8 in FIG. 1) is replaced with the ceramic seal, also referred to as gasket 26, which is fixed in place to the sheath 18 and the electrode 20. The ceramic material of the gasket 26 provides electrical resistance between the sheath 18 and the electrode 20. The preferred material composition of the seal 26 is aluminum oxide, however other electrically insulating ceramic materials may be used. A discrete ceramic component 26 is preferably used, which results in an effective, inexpensive and robust sealing technique which extends the service life of a glow plug 10 by reducing the risk of degradation due to oxidation of the wire heating element 22.

The gasket 26 is shown, for example, having reduced diameter nose region 44 sized for a slight clearance fit within the open end 36 of the sheath 18 and an enlarged diameter region 46 having about the same outer diameter as the sheath 18 and concentrically formed with the reduced diameter region 44. As such, a planar shoulder 48 extends radially between the reduced diameter region 44 and the enlarged diameter region 46. To fix the gasket 26 to the sheath 18, the nose region 44 is disposed in the sheath 18 until the shoulder 48 confronts and abuts the open end 36 of the sheath 18. Then, a first braze joint 50 is formed within the annular gap formed by the slight clearance fit between and outer surface of the nose region 44 and an inner surface of the sheath 18, wherein the braze joint 50 fills the annular gap and produces a hermetic seal between the nose region 44 and an inner surface of the sheath 18. The gasket 26 also has a central through bore 52 sized for a slight clearance fit about the electrode 20. To fix the gasket 26 to the electrode 20, a second braze joint 54 is formed within the annular gap formed by the slight clearance fit between and outer surface of the electrode 20 and the through bore 52 of the gasket 26, wherein the braze joint 54 fills the annular gap and produces a hermetic seal between the electrode 20 and the through bore 52. Accordingly, the braze joints 50, 54 produce a hermetic seal between the powder bed 24 containing the heating wire 22 and the outside atmosphere.

A secondary feature of the subject invention is that the parts are preferably processed and assembled in such a way that oxygen and water vapor are removed from the packing powder bed 24 during the sealing process. Thus, in a preferred method of constructing the heater probe assembly 16, the braze joints 50, 54 are formed in a brazing process in a vacuum, or in an atmosphere such as an inert gas, for example, so that the magnesium oxide powder 24 is off-gassed prior to formation of the braze joints 50, 54, thereby removing reactants such as oxygen and water that could otherwise contribute to degradation of the heating element wire 22.

The foregoing invention has been described in accordance with the relevant legal standards, thus the description is exemplary rather than limiting in nature. Obviously, many modifications and variations of the present invention are possible in light of the above teachings. It is, therefore, to be understood that within the scope of the appended claims, the invention may be practiced otherwise than as specifically described.

What is claimed is:

1. A metallic glow plug assembly, comprising:
a metal shell having a through bore;
a metal sheath extending between a distal end and a terminal end, said terminal end being fixed in said shell;
an electrode having an end received in said sheath;
a heating element attached to said end of said electrode and being received in said sheath;
a packing powder disposed in said sheath about said heating element; and
a ceramic seal having an outer surface attached to said sheath by a braze joint and having an inner surface attached to said electrode by a braze joint, said ceramic seal providing a hermetic seal between said packing powder and an environment external to said sheath.

2. The metallic glow plug assembly of claim 1 wherein said ceramic seal has a reduced diameter region sized for a clearance fit in said sheath and a through opening sized for a clearance fit about said electrode, one of said braze joints extending between said reduced diameter region and said sheath and the other of said braze joints extending between said through opening and said electrode.

3. The metallic glow plug assembly of claim 2 wherein said ceramic seal has an enlarged diameter region and a planar shoulder extending between said reduced diameter region and said enlarged diameter region, said shoulder abutting said terminal end of said metal sheath.

4. The metallic glow plug assembly of claim 1 wherein said ceramic seal is aluminum oxide.

5. A glow plug heater probe assembly, comprising:
a metal sheath extending between a distal end and a terminal end;
an electrode having an end received in said sheath;
a heating element attached to said end of said electrode and being received in said sheath;
a packing powder disposed in said sheath about said heating element; and
a ceramic seal having an outer surface attached to said sheath by a first braze joint and having an inner surface attached to said electrode by a second braze joint, said ceramic seal providing a hermetic seal between said packing powder and an environment external to said sheath.

6. The glow plug heater probe assembly of claim 5 wherein said outer surface of said ceramic seal is sized for a clearance fit in said sheath to provide an annular gap between said outer surface and said sheath, said first braze joint substantially filling said annular gap.

7. The glow plug heater probe assembly of claim 6 wherein said inner surface of said ceramic seal is sized for a clearance fit about said electrode to provide an annular gap between said inner surface and said electrode, said second braze joint substantially filling said annular gap.

8. The glow plug heater probe assembly of claim 5 wherein said ceramic seal has a shoulder abutting said terminal end of said metal sheath.

9. The glow plug heater probe assembly of claim 8 wherein said shoulder extends between a reduced diameter region of said ceramic seal and an enlarged diameter region of said seal.

10. The glow plug heater probe assembly of claim 9 wherein said reduced diameter region of said ceramic seal is received in said sheath.

11. The glow plug heater probe assembly of claim 10 wherein said first braze joint extends between said reduced diameter region of said ceramic seal and said sheath.

12. The glow plug heater probe assembly of claim 5 wherein said ceramic seal is aluminum oxide.

13. A method of constructing a glow plug heater probe assembly, comprising:
providing a metal sheath having an open end;
providing an electrode;
attaching a heater element to the electrode;
disposing the heater element and an end of an electrode into the sheath;
disposing packing powder about the heater element in the sheath;
disposing a ceramic seal about the electrode and within the sheath; and
forming a braze joint between the sheath and the electrode to provide a hermetic seal between the packing powder and an environment external to the sheath.

14. The method of claim 13 wherein the forming a braze joint step includes forming a first braze joint between an outer surface of the ceramic seal and the sheath.

15. The method of claim 14 wherein the forming a braze joint step includes forming a second braze joint between an inner surface of the ceramic seal and the electrode.

16. The method of claim 13 further including out-gassing reactants from the packing powder in a vacuum prior to forming the braze joint.

* * * * *